United States Patent [19]

Evans

[11] 4,377,136

[45] Mar. 22, 1983

[54] ROTARY PISTON ENGINE

[76] Inventor: Lyle B. Evans, 9135 SW Summerfield Ct., Tigard, Oreg. 97223

[21] Appl. No.: 153,430

[22] Filed: May 27, 1980

Related U.S. Application Data

[63] Continuation-in-part of Ser. No. 921,965, Jul. 5, 1978, abandoned.

[51] Int. Cl.[3] ..... F02B 57/04

[52] U.S. Cl. ..... 123/44 C

[58] Field of Search ..... 123/44 R, 44 C, 44 D, 123/59 B, 59 BS, 226

[56] References Cited

U.S. PATENT DOCUMENTS

| | | | |
|---|---|---|---|
| 890,532 | 6/1908 | Schmucker | 123/44 C |
| 998,284 | 7/1911 | Ebersole | 123/44 C |
| 1,980,924 | 11/1934 | McDonald | 123/44 C |
| 2,990,820 | 7/1961 | Saijo | 123/44 D X |
| 3,292,603 | 12/1966 | Wayto | 123/44 D X |
| 3,931,809 | 1/1976 | Corte et al. | 123/44 C X |
| 4,178,885 | 12/1979 | Konther et al. | 123/44 C |
| 4,318,370 | 11/1979 | Konther et al. | 123/44 C |

FOREIGN PATENT DOCUMENTS

| | | | |
|---|---|---|---|
| 1176919 | 8/1964 | Fed. Rep. of Germany | 123/44 C |
| 13269 | 12/1910 | France | 123/44 C |
| 725437 | 11/1966 | Italy | 123/44 C |

*Primary Examiner*—Michael Koczo

*Attorney, Agent, or Firm*—James D. Givnan, Jr.

[57] ABSTRACT

An engine including a piston yoke assembly reciprocating within a rotor assembly disposed for rotation within a fixed casing. The rotor assembly is of elliptical configuration to form a pair of exhaust chambers located between the assembly and the casing interior. The rotor assembly defines closed end combustion chambers and fuel-air chamber within which the yoke portion of the piston yoke assembly reciprocates to pressurize fuel-air charges for transfer to the combustion chambers. The piston yoke assembly comprises a part of the rotor assembly but moves about a fixed component carried by the engine casing resulting in reciprocal movement of the piston yoke assembly within the rotor assembly. Power is delivered to the rotor assembly by ignition of a fuel-air charge acting on a piston and yoke assembly off center from the fixed casing component. Exhaust ports within the rotor assembly provide for the ejection of exhaust gases asymmetrical to the rotor axis to impart torque to the rotor. Engine cooling is accomplished by the admission of ambient air to the pair of exhaust chambers and by heat transfer from engine pistons to a fuel-air mixture. In a second described form of the engine the rotor assembly is provided with blades which move a cooling air flow axially through the fixed casing. The second engine form further includes ignition components located on the forward side of the rotor assembly. Combustion gases are exhausted from the casing interior by a barrier riding on the rotor periphery.

8 Claims, 15 Drawing Figures

ROTARY PISTON ENGINE

BACKGROUND OF THE INVENTION

An earlier copending parent U.S. application filed July 5, 1978 under Ser. No. 921,965 under the same title disclosed subject matter in common with a portion of the present application, a continuation-in-part of the earlier application filed under Ser. No. 921,965 and now abandoned.

The present invention falls within that general class of engines having an internal rotor assembly with reciprocating piston means therein.

The general concept of a cylindrical rotor assembly within an engine casing including a reciprocating piston or pistons is old in view of the following and perhaps other U.S. Patents:

| | | |
|---|---|---|
| 890,532 | 3,279,445 | 3,968,777 |
| 4,030,458 | 3,289,655 | 3,991,728 |
| French Patent 013,269 | German Patent 1,176,919 | |

Common to known rotary engines of the type having reciprocating pistons within a rotor assembly is a sealing problem as the rotating combustion chamber in such engines is partially defined by an interior wall surface of a stationary engine casing. A precise fit between rotor and casing would obviate such seals but such an approach is unrealistic in view of the wear factor. Extreme temperatures and abrasive wiping contact with the casing or rotor surfaces resulting in a short seal life. Further, the rotary engines known are limited to low compression ratios because of such seals. Other drawbacks in some of the known engines include the use of connecting rods and reliance on powerless exhaust strokes for exhausting combustion gases. Such known engines, being limited to low compression ratios, cannot fully utilize energy available from the burning of hydrocarbon fuels at extreme temperatures and pressures.

U.S. Pat. 890,532 is of interest for the reason that the engine disclosed includes an offset stationary crank pin about which pairs of pistons, rods and yokes rotate to impart reciprocating piston movement within a rotor assembly rotating about an axis offset from the crank pin. A crank chamber receives fuel via a crankshaft bore which is subsequently assertedly drawn into each cylinder behind the piston and thereafter urged by the piston inner end into an auxiliary fuel storage chamber from whence fuel subsequently moves into the cylinder ahead of the piston via a second intake port or passageway. The fuel chamber houses the pair of yokes moving at right angles to one another resulting in the chamber being incapable of pressurization. Further, routing of the fuel mixture includes first and second intake passages and an auxiliary chamber to severely hinder volumetric efficiency of the intake system. Still further, the ignition system includes slip rings each in wired circuit with a cylinder spark plug. No provision is made for a casing nor moving a cooling airflow past the rotating engine structure.

French Pat. No. 013,269 discloses pistons each having a piston rod terminating in a yoke structure which structure additionally includes a piston facing surface which propels a fuel-air charge into an intake manifold ring. The fuel-air charge passes through flapper valves carried by said yoke member. Advancement of the yoke transfers the charge into said circular intake manifold for temporary storage prior to release into an engine cylinder.

German Pat. No. 1,176,919 discloses a flat sided piston having a rectangular opening within which is a block with eccentric piston movement and rotary block movement compelled by a stationary crank pin offset from the axis of rotor assembly rotation. No provision is made for a yoke nor dissipation of heat. The engine does not lend itself to conventional low cost manufacturing operations.

SUMMARY OF THE PRESENT INVENTION

The present invention is embodied within an internal combustion engine having an internal rotor assembly including multiple pistons with closed end combustion chambers defined by rotor wall structure.

The rotor assembly of the present engine is concentrically disposed within a stationary engine casing. Integral with the stationary engine casing but eccentric thereto is a stationary shaft about which a piston yoke assembly moves as it reciprocates within the rotor. The present piston yoke assembly includes a pair of pistons which reciprocate within rotor defined bores wholly defined by internal rotor wall surfaces to obviate a seal requirement. The yoke of the piston yoke assembly is disposed intermediate the pistons interconnecting same in a unitary manner. The yoke reciprocates within a rotor defined fuel-air chamber to pressurize a fuel-air mixture and form a charge momentarily stored with an intake port. Intake and exhaust flows from the cylinders are regulated by the cylinder piston thereby dispensing with valving. The yoke defines an elongate, shaft receiving opening whereby the said shaft, being static, will constrain the piston yoke assembly for reciprocal movement during rotor assembly rotation about the casing axis from which the shaft axis is offset.

The rotor assembly has exhaust ports orientated so as to cause rotor exhaust to be discharged adjacent a rotor end and hence impart thrust to same. As earlier mentioned, the rotor assembly is elliptical and thereby defines, along with the engine casing interior, crescent shaped, moving exhaust chambers for the reception of exhaust gases. A barrier rides on the rotor periphery to compel scavenging of exhaust gases from the moving exhaust chambers. An air inlet permits entry of ambient air into a forming exhaust chamber coincident with rotation of the elliptical rotor assembly. Concentric with the rotor assembly is an output shaft and a lubricant reservoir provided with an oil pump disc for pressurizing engine lubricant lines.

A second described form of the motor includes a rotor assembly with blade appendages which impel an ambient cooling airflow past the rotor and through ports in the end plates of the casing. Cam elements are mounted in an exposed manner exteriorly on the rotor assembly to trigger ignition impulses.

Important objectives of the present invention include the provision of an engine of compact design having a rotor assembly including a unitary piston and yoke assembly with the yoke having fuel-air mixture compressing surfaces driving a fuel-air charge to an oppositely located remote combustion chamber; the provision of an engine wherein ignition components are within engine pistons; the provision of an engine design capable of extreme compression ratios to best utilize the fuel-air mixture from a power output standpoint; the provision of an engine having a piston yoke assembly wherein the yoke additionally serves to pressurize a fuel-air charge into an intake port for subsequent and direct release of the charge into the inner segment of an engine cylinder; the provision of an engine which has a power stroke every half-cycle; the provision of an engine partaking power from the exhaust of generated combustion gases into moving exhaust chambers within an engine casing; the provision of an engine having relatively few components for simplicity of construction and servicing; the provision of an engine utilizing a fuel-air mixture for cooling of reciprocating piston components; the provision of an engine having a rotor assembly with impellor blades thereon moving ambient air axially through the motor and past relatively large surface areas formed on the rotor to cool same; the provision of igniter elements carried by the rotor assembly in a highly accessible manner to simplify servicing and the remaining ignition system.

DETAILED DESCRIPTION OF THE PREFERRED EMBODIMENTS

Figure 1:
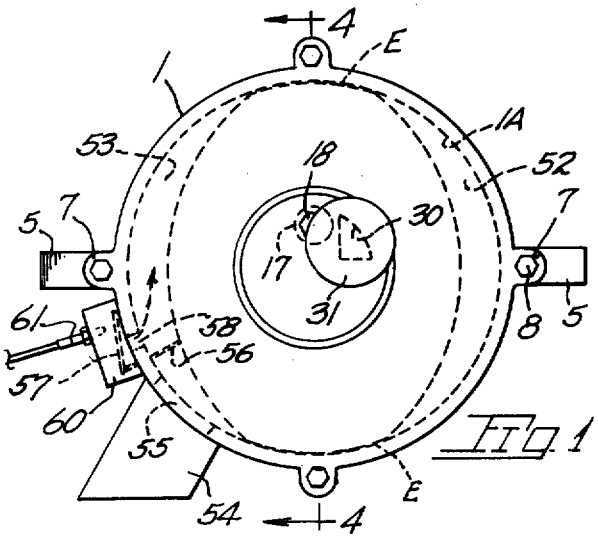
FIG. 1 is a front elevational view of the present engine.

With continuing attention of the accompanying drawings, reference numeral 1 indicates an engine casing having an annular wall 1A and a back wall 2 and defining an interior cylindrical chamber 3 within which a later described rotor assembly is housed. The casing includes mounts at 5 for casing securement. Closing the casing is an end plate 6 having ears 7 thereon for the reception of casing engaging fasteners 8.

A lubricant tank at 11 is affixed to back wall 2 of the casing with a pump disc at 12, carried by a motor output shaft 15 and pressurizing a lubricant flow through a line 13. A cover plate 14 closes the lubricant tank and includes a suitable shaft oil seal.

Secured to end plate 6 of the engine casing is a fixed shaft 17 the axis X of which is offset from axis Y of the engine casing. A fastener 18 retains the shaft in fixed, offset relationship to the casing axis. For shaft support, end plate 6 is bored to receive an inset shaft end. Shaft 17 serves to compel reciprocal movement of a piston yoke assembly within the later described elliptical rotor of the engine.

An engine rotor assembly, hereinafter occasionally referred to as a rotor, as best viewed in FIGS. 3 and 4, comprises front and rear face plates 20 and 21 between which a pair of opposed rotor heads 22 and 23 are secured by inset cap screws as at 19. The assembled rotor heads and face plates provide a rotor of elliptical configuration with rotor ends at E being formed on a radius complimentary to the radius of interior annular wall 1A of the casing. Rotor heads 22–23 each define a closed end combustion chamber 22A–23A. Rotor head 22 defines an exhaust port 24 while rotor head 23 defines an exhaust port 25. Fuel-air intake ports at 26 and 27 in each rotor head as well as the exhaust ports 24–25 are laterally closed by the rotor face plates 20 and 21. The rotor heads include interior walls 28 and 29 which, with said face plates and the later described piston yoke assembly, define communicating fuel-air chambers C in communication with said intake ports 26 and 27. The fuel-air chambers C receive a fuel-air flow via a port 30 in casing end plate 6 which port is served by a carburetor 31. Communicating fuel-air chambers C with port 30 is an intermediate open area 32 (FIGS. 4 and 5) jointly defined by an end plate bearing flange 33 plate 6 and the rotor assembly. Flange 33 exteriorly carries a bearing 34 the outer race of which seats within the inner periphery 20A of rotor face plate 20.

A piston yoke assembly generally at 35 comprises first and second pistons 36–37 both integral with a central yoke 38 having an elongate, transversely orientated opening 39 through which fixed shaft 17 extends. The front and rear sides or faces of the yoke adjacent front and rear rotor face plates 20 and 21 are each provided with seals as at 40 which ride on the inner surfaces of the rotor face plates during yoke reciprocation. As viewed in FIG. 3, the yoke during subsequent or downward movement in fuel-air chambers C draws a fuel-air flow through port 30 to charge that area forming above the yoke fuel compressing surface. It will be appreciated that the term "downward" is used simply for purposes of explanation as the piston yoke movement is of course rotational as well as reciprocal the latter relative to the rotor assembly.

Figure 5:
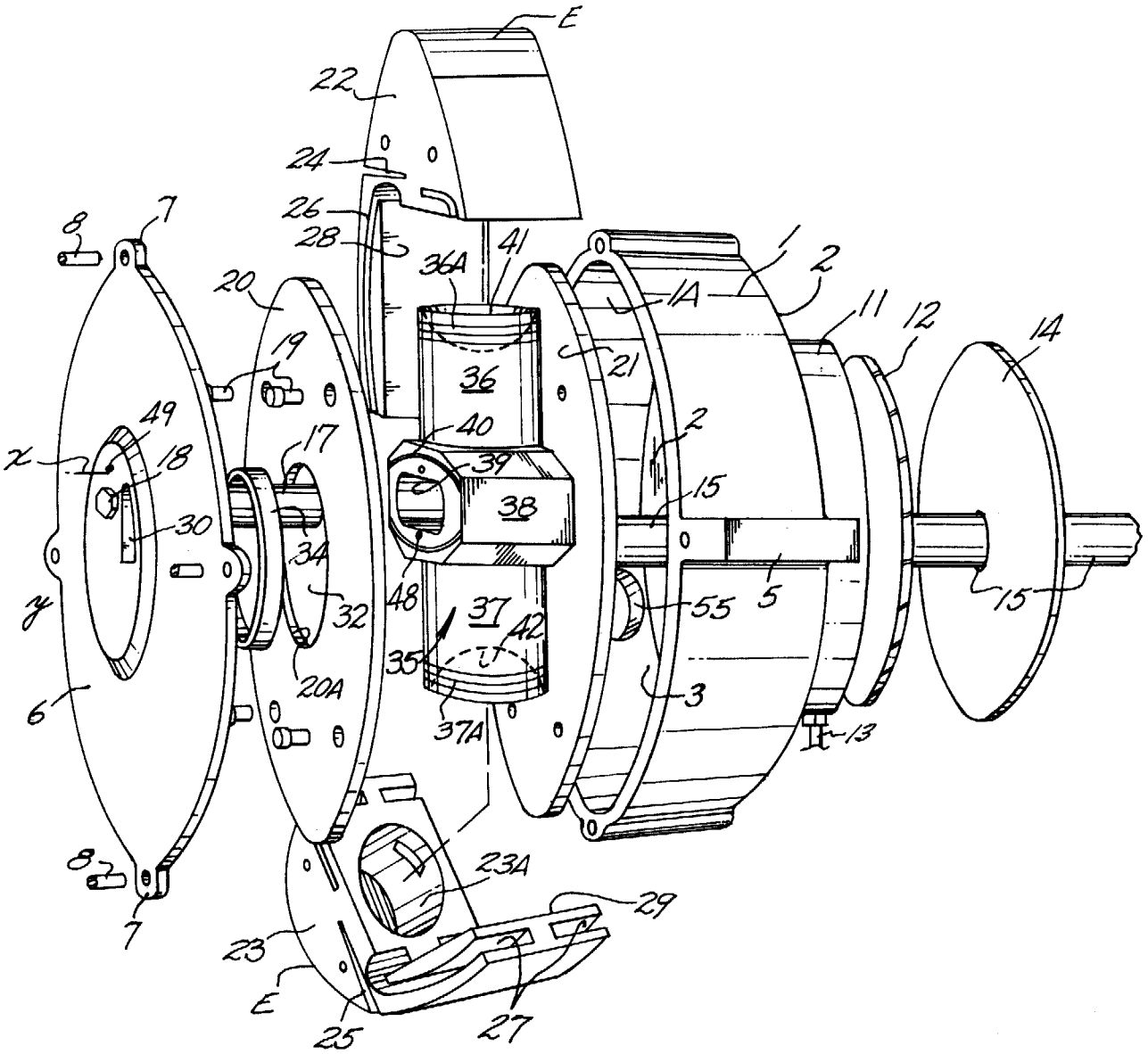
FIG. 5 is an exploded view of the present engine.

The pistons 36 and 37 have heat dissipating walls and include piston rings 36A–37A (FIG. 5). The outer end of each piston is of concave, hemispherical shape at 41–42. An igniter element, which may be of the gapped type, is indicated at 43–44 suitably seated within each of the hemispherical piston walls. Ignition component leads 45 and 46 extend from a terminal on each of the igniters respectively to contacts 47–48 on the yoke front wall. Each of said contacts moves past the inner end of an ignition terminal 49 in casing end plate 6.

Figure 2:
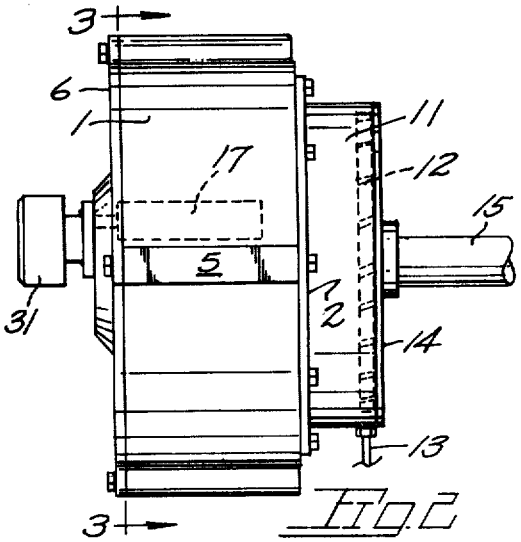
FIG. 2 is a side elevational view of FIG. 1.

With attention to FIGS. 1 and 2, an exhaust stack at 54 is in communication with casing interior via exhaust port 55 formed therein. To compel discharge of combustion gases from the moving, crescent-shaped exhaust chambers at 52–53, located intermediate the elliptical rotor assembly and the casing wall 1A, a barrier at 56 rides in lightly biased contact with the rotor which barrier is shown in combination with a flutter valve 57 which opens and closes a casing port 58 in response to inward and outward barrier movement as biased by the elliptical rotor assembly wall. Cooling ambient air accordingly is admitted to the casing interior. For purposes of lubrication of casing and rotor surfaces, an oil atomizing device 61 is located within a flutter valve housing 60 for intake via port 58.

Figure 3:
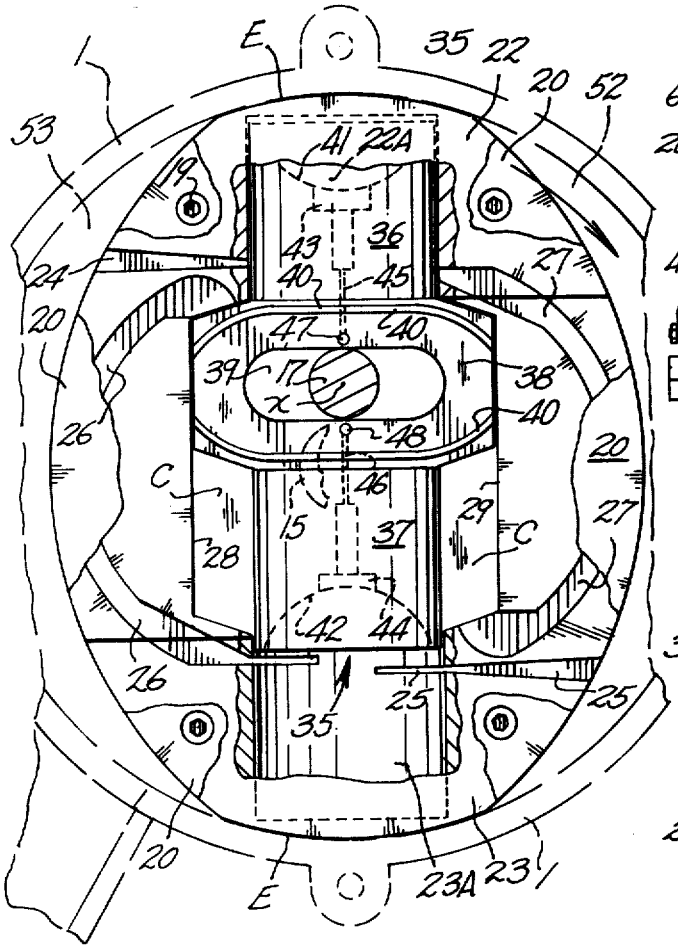
FIG. 3 is a vertical sectional view taken along line 3—3 of FIG. 2 with the casing shown in phantom lines.
Figure 4:
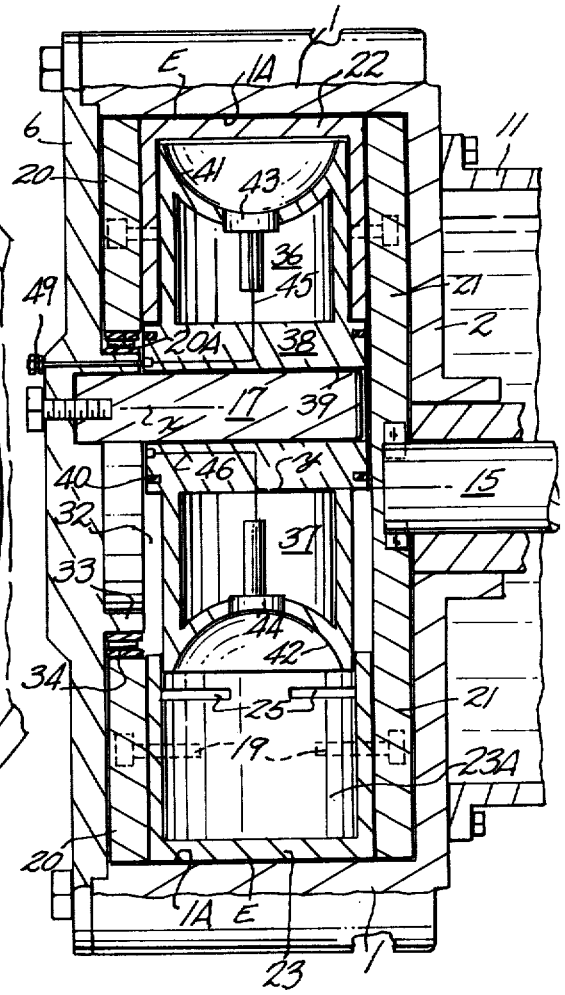
FIG. 4 is a vertical sectional view taken along line 4—4 of FIG. 1.
Figure 6:
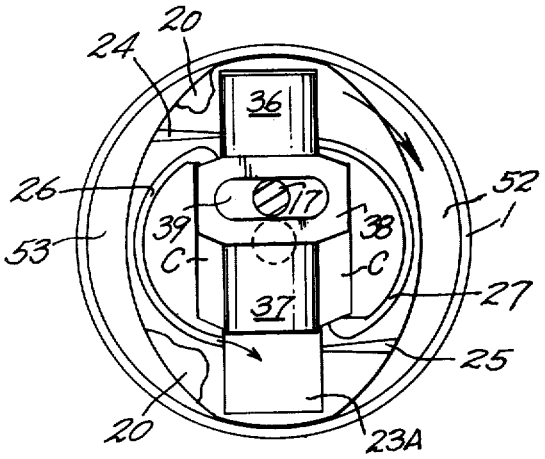
FIGS. 6, 7, 8 and 9 are schematics of the rotor assembly through one cycle shown at ninety degree intervals from top dead center.
Figure 8:
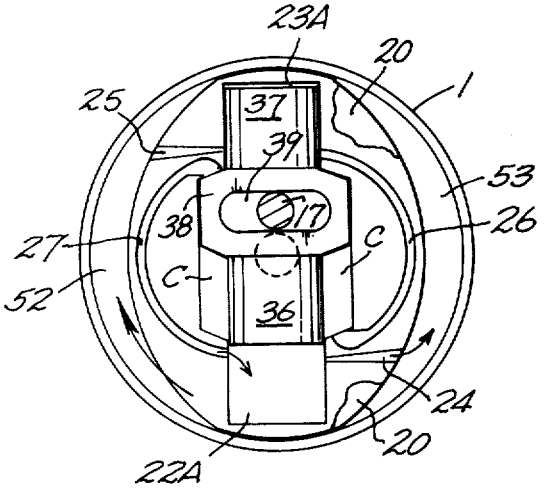
Figure 9:
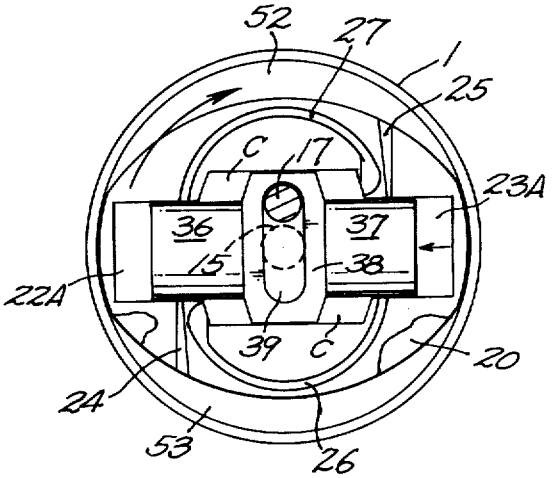

In operation, initial cranking of the rotor assembly by a starter unit (not shown) rotates output shaft 15 with the rotor driven in a clockwise direction as viewed in FIG. 3. With attention now to FIG. 7, at 90 degrees of rotor movement, yoke 38 is medial of fuel-air chambers C and has drawn a fuel-air mixture into one of same via port 30 and space 32 while simultaneously pressurizing a fuel-air mixture in remaining chamber C in advance of the moving yoke to form a fuel-air charge in intake port 27. At 180 degrees (FIG. 8), the piston 36 has moved outwardly past the discharge opening of port 27 for introduction of the pressurized fuel-air charge stored therein. Combustion chamber 22A is scavenged via port 24 by the charge. In FIG. 9 at 270 degrees of rotation, piston 36 has now advanced midway into rotor defined combustion chamber 22A to close both its intake and exhaust ports 27, 24 and to partially compress the fuel-air charge. At approximately 360 degrees or earlier in FIG. 6, ignition occurs. Rotor assembly inertia positions same clockwise past dead center whereat the major axis of piston 36 is now in a plane offset in the direction of rotor rotation from the axis of shaft 17. Further rotation of the rotor assembly increases the offset relationship of the above mentioned piston-shaft axes to provide an arm therebetween acting on the rotor and at its greatest magnitude at the 90 degree position of FIG. 7. Power is accordingly imparted to output shaft 15 by the rotor assembly.

Figure 7:
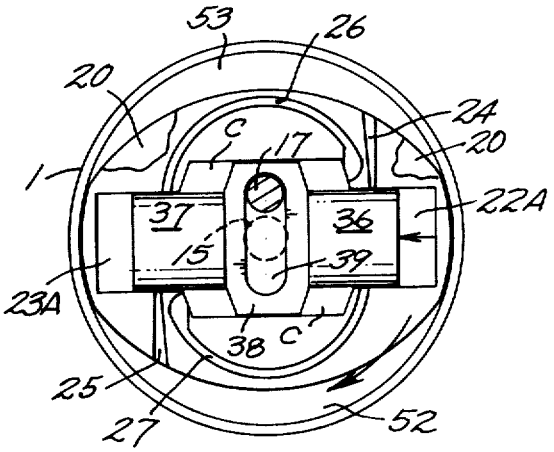

With continuing attention to FIG. 7, movement of the piston yoke assembly resulting from combustion will be in the arrow-indicated direction with yoke 38 both drawing in a fuel-air mixture into one rotor chamber C while advancing to pressurize the remaining chamber C and compress a fuel-air charge into intake port 27.

With attention again to FIG. 8, with the rotor assembly at 180 degrees, piston 36 has moved outwardly of combustion chamber 22A and to open exhaust port 24 substantially contemporaneous with the opening of intake port 27 to permit the pressurized fuel-air charge entering the compression chamber to scavenge same. Importantly, opening of exhaust port 24 by cylinder extraction permits forceful expansion of combustion gases through port 24 into exhaust chamber 53 to impart asymmetrical thrust to the rotor end which thrust acts along an arm perpendicular to output shaft axis 15 to contribute additional power to the rotor assembly. Combustion gases so ejected from the combustion chambers are received within the crescent-shaped exhaust chambers 52,53. Said chambers will be near ambient atmospheric pressure to permit admission of the exhaust flow from each compression chamber at each half-cycle of rotor rotation. Exhaust gases within the crescent-shaped exhaust chambers exhaust via port 55 in the engine casing as compelled by barrier 56. During formation of a new exhaust chamber upon passage of a rotor extremity past barrier 56, an air flow is drawn into the forming chamber to assist in engine cooling. Further cooling of the engine is realized from the reciprocation of pistons 36 and 37 into fuel-air chambers C for the transfer of heat to the fuel-air mixture.

Figure 10:
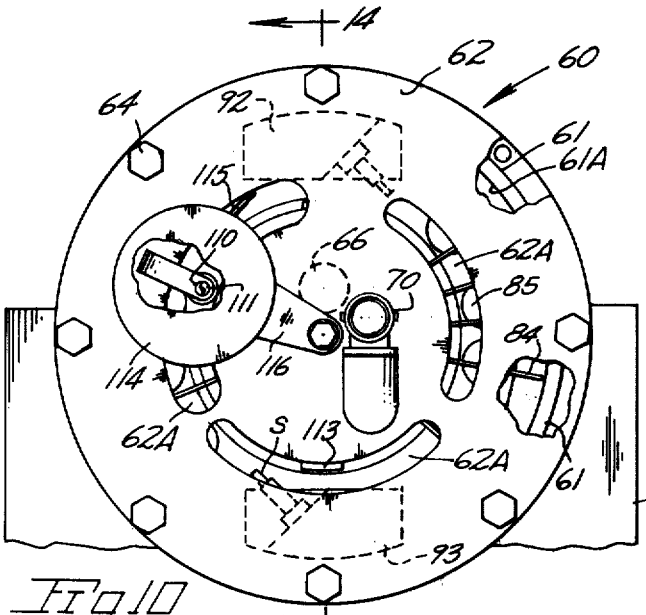
FIG. 10 is a front elevational view of a second embodiment of the engine.

In the modified form of the engine as shown in FIG. 10 and subsequent Figures, reference numeral 60 indicates generally an engine casing having an annular wall 61 the interior surface 61A thereof defining a cylindrical chamber. Front and rear end plates 62 and 63 define openings 62A and 63A (FIG. 11) for the purpose of permitting axial passage of a cooling airflow. Bolts 64 tie the end plates to one another and to annular wall casing 61. Engine mounting brackets are at 65. An engine output shaft is at 75 suitably journalled within a bearing 76 in a bearing retainer 77 on plate 63.

Secured to front end plate 62 is a fixed or static shaft means 66 which projects inwardly of the casing with a shaft axis at X' being parallel to and offset from a casing aixs Y'. Concentric with the casing axis Y' is a boss 67 formed integral with front end plate 62. Boss 67 additionally supports shaft 66 and defines a fuel-air intake means shown as a passage 68 terminating forwardly in communication with a carburetor 70 carried by the front end plate 62.

An internal rotor assembly generally at 71 includes front and rear plates 80 and 81 with the former including a bearing retainer sleeve 82 within which is secured the race 83 of a roller bearing. Front rotor assembly plate 80 includes blade means 84 which are set at a pitch angle (not shown) to draw ambient air through casing front wall openings 62A and impart substantially axial movement to same for ultimate discharge through rear casing openings 63A. Such air movement is partially through rotor assembly open areas 85 in a rotor body 89. Blade securement to front face plate 80 may be by a pressed fit or other suitable securement. Rotor body 89 includes rotor heads at 86 and 87 each of which defines a bore 88 and 89 (also termed combustion chambers) closed by rotor body end walls 90 and 91. Each rotor head 86 and 87 is provided with an igniter component block at 92 and 93 each internally threaded to receive an igniter or spark plug S having its electrodes disposed within block bores 92A–93A each in communication with the outer end of a rotor head bore. The terminal or innermost ends of the spark plug components terminate inwardly for contact with a stationary ignition lead as later described. Exhaust ports are at 94 and 95 while intake ports at 96 and 97 serve the inner segments of combustion chamber bores 88–89 with each intake port in direct upstream communication with a fuel-air chamber C' defined by the rotor body interconnecting the rotor heads. Chamber C' is, during engine operation, in effect two chambers by reason of a piston yoke 100 reciprocating therein with first and second fuel compressing surfaces 100A–100B alternately pressurizing fuel-air charges for remote combustion chambers 89 and 88. The intake and exhaust ports formed in each rotor head are disposed so as to be open concurrently for bore scavenging and admission of a fuel-air charge from chamber C' via an intake port. Fuel intake passage 68 terminates inwardly in open communication with chamber C' while front and rear face plates 80 and 81 axially define fuel-air chamber C'.

A piston yoke assembly comprises, in addition to yoke 100, first and second aligned pistons 101–102 integral with an oppositely carried by central yoke 100. Said yoke defines an elongate, transversely extending opening 104 therein which receives fixed shaft means 66 about which the piston yoke assembly eccentrically orbits during rotor assembly rotation. The pistons are suitably provided with piston rings. Seals at 105 are adjacent yoke fuel-air compressing surfaces and across the yoke ends.

Figure 11:
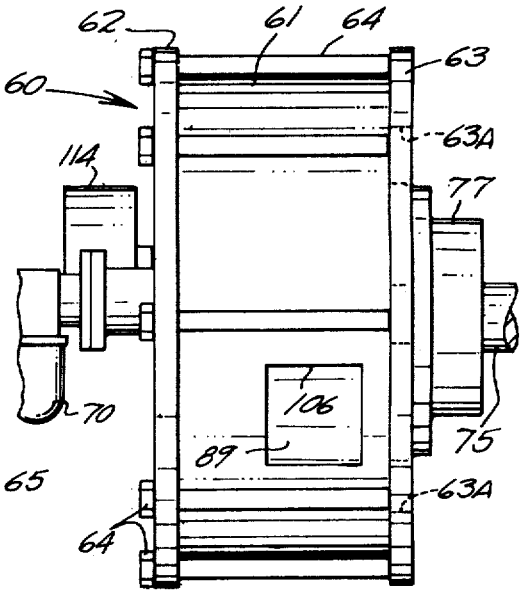
FIG. 11 is a side elevational view of FIG. 10.
Figure 12:
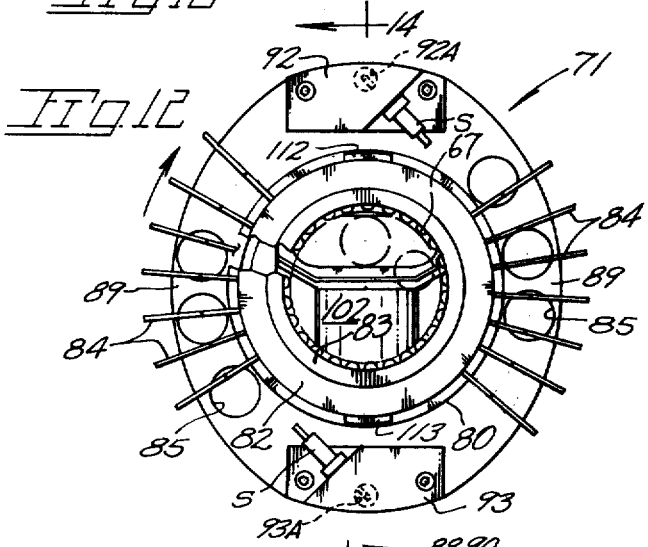
FIG. 12 is a front elevational view of the second embodiment rotor assembly removed from the casing.

An exhaust port 106 in FIG. 11 vents a moving crescentshaped exhaust chamber as at 107 defined by casing wall surface 61A and the exterior surface of the rotor body.

Carburetor 70 vaporizes a fuel-air mixture with the liquid fuel used having a lubricant premixed therewith in the ratio used for two-cycle engines. Engine intake passage 68 admits the fuel-air mixture to chamber C' in which the mixture is compressed by yoke surfaces 100A–100B for momentary confinement within a bore intake port 96 or 97 prior to direct discharge into the inner end segment of a combustion chamber. Beneficial heat transfer occurs from the piston yoke assembly to the compressed charge.

Figure 13:
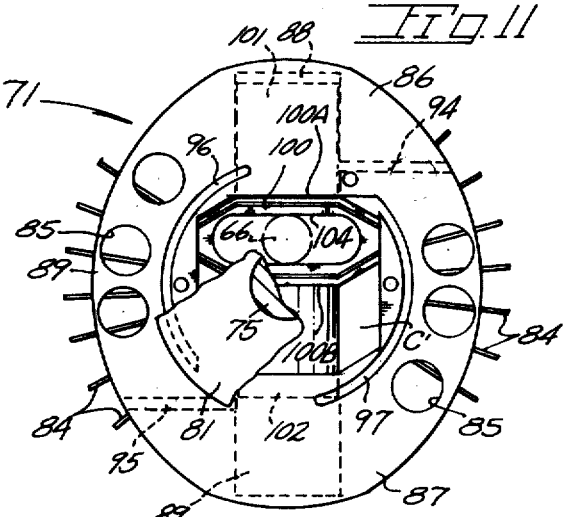
FIG. 13 is a rear elevational view of the rotor assembly of FIG. 12.
Figure 14:
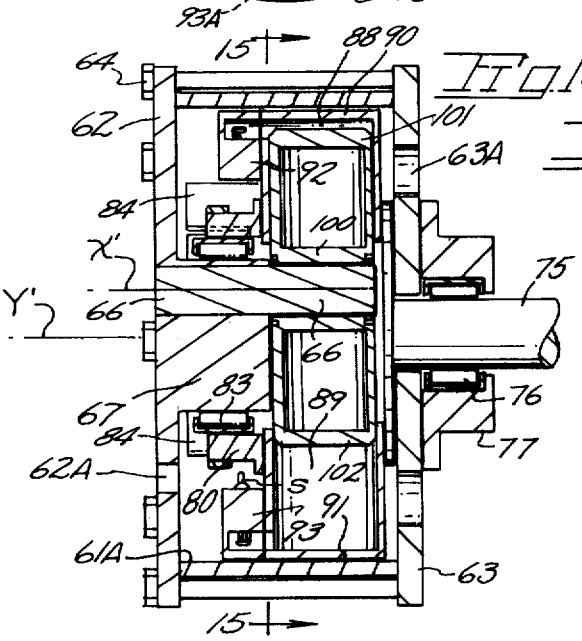
FIG. 14 is a vertical sectional view taken along line 14—14 of FIG. 10.
Figure 15:
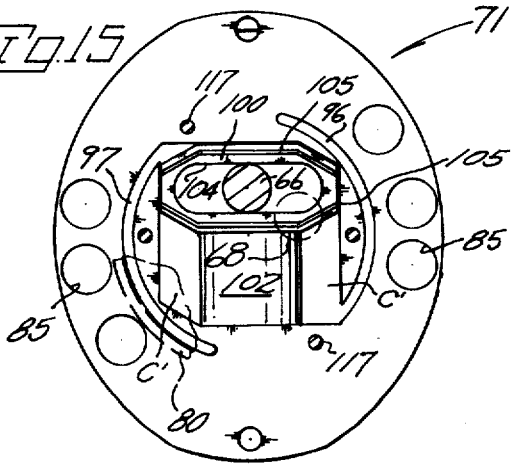
FIG. 15 is a vertical sectional view of the rotor assembly taken along line 15—15 of FIG. 14.

Ignition of a fuel-air charge in a combustion chamber is triggered by rotor carried actuators 112–113 acting on a pair of aligned contacts as at 110–111 the innermost contact 111 having its inner end disposed in the rotational path of the actuators shown as cams located on front rotor plate 80. A contact supporting ignition unit 114 additionally carries an ignition lead 115 located in the path of the ends or terminals of ignition component S. Lead 115 may be in circuit with the secondary coil with contacts 110–111 opening and closing a primary coil (not shown). The ignition system components of course may vary to include solid state components. Ignition support unit 114 is readily arcuately positionable by reason of a mounting arm 116 being swingably coupled to casing end plate 62 enabling ignition advancement or retardation. Piston 101 is shown at top dead center in FIG. 13. Timing of ignition has been found suitable when occurring at twenty-five to thirty degrees before top dead center but may vary with the fuel utilized and other criteria.

Rear face plate 81 of the rotor assembly receives, in a recessed manner, socket head cap screws at 117 having inset heads which serve to assemble the rotor assembly parts and to secure engine output shaft 76 to the rotor assembly.

The operation of the second described preferred form of the engine is substantially as the earlier described operation of the first form of the engine. The second form may include a pressurized lubrication system as of the type earlier described. Importantly, both engine cooling and lubrication as wall as compact engine size is achieved by reciprocation of the pistons into the fuel-air chamber for a major portion of their length.

In one embodiment of the engine the inside diameter of casing wall 61 is eight inches, piston yoke assembly is of a length of five and three-quarters inches with a yoke width of three inches; static shaft 66 is of seven-eighths inch diameter with shaft axis X' offset from the casing axis Y' a distance of thirteen-sixteenths of an inch.

Carburetion is suitably provided by a motorcycle engine carburetor of the type manufactured by the Honda Company.

While I have shown but a few embodiments of the invention it will be apparent to those skilled in the art that the invention may be embodied still otherwise without departing from the spirit and scope of the invention.

Having thus described the invention, what is desired to be secured under a Letters Patent is:

I claim:

1. A rotary internal combustion engine comprising, a fixed casing defining a cylindrical chamber and having fuel intake means and exhaust means in communication with said chamber, an elliptical rotor assembly for rotation within said casing chamber about an axis and including rotor heads each defining a combustion chamber, a piston yoke assembly including pistons and an interconnecting yoke portion having side faces and reciprocally mounted within said rotor assembly and rotatable about a second axis offset from the rotor assembly axis, a fuel-air chamber within said rotor assembly within which said yoke reciprocates to alternately pressurize a fuel-air mixture for said combustion chambers, ignition components carried by said rotor assembly, said rotor assembly being of substantially elliptical configuration with rotor assembly ends each having a peripheral surface portion substantially corresponding in curvature to the inner surface of the casing wall and closely adjacent thereto so as to partially define separate exhaust chambers, said casing having an end plate, said end plate and said rotor assembly jointly defining an area through which fuel and air pass to enter said fuel-air chamber, and fixed means on said casing in engagement with said yoke portion to constrain same for rotation about said second axis and thereby impart rotational force to the rotor assembly subsequent to ignition of a fuel-air charge in a combustion chamber.

2. The engine claimed in claim 1 wherein said rotor assembly defines exhaust ports one each communicating a combustion chamber with one of said exhaust chambers defined by the rotor assembly and said casing, said exhaust ports offset from the rotor assembly axis whereby exhaust gases emitted from said ports contribute to driving the rotor assembly.

3. The engine claimed in claim 1 additionally including an exhaust barrier on said casing in riding contact with the rotor assembly periphery.

4. In an engine having a casing with fuel-air intake and exhaust openings, a rotor assembly with an axial output shaft carried by said casing, fixed shaft means on said casing offset radially from the rotor assembly axis and extending inwardly for rotor assembly engagement, the improvement comprising, said rotor assembly defining closed end combustion chambers and a fuel-air chamber, a piston yoke assembly reciprocally carried by said rotor assembly and comprising pistons and a yoke portion interconnecting said pistons, said pistons reciprocal within said combustion chambers, igniter means, said yoke portion having seal means extending thereacross, said yoke portion reciprocal within said fuel-air chamber to pressurize fuel-air charges for alternate delivery to said combustion chambers, said yoke portion defining an elongate opening transverse to projected piston axes and receiving said fixed shaft means whereby rotor assembly rotation imparts reciprocal motion to the piston yoke assembly, ignition of a fuel-air charge within a combustion chamber causing said piston yoke assembly to impart forces to the remaining rotor assembly to drive same about the rotor assembly axis, said rotor assembly being substantially elliptical in elevational shape and defining openings parallel to and radially offset from the rotor assembly axis for air passage with rotor ends each having a peripheral surface portion substantially corresponding in curvature to the inner surface of the casing wall and closely adjacent thereto, said rotor assembly ends along with the casing annular wall partially defining crescent-shaped exhaust chambers.

5. The invention claimed in claim 4 wherein an exhaust barrier carried by the casing is in riding contact with the rotor assembly periphery to compel sequential discharge of exhaust gases from the exhaust chambers.

6. A rotary internal combustion engine comprising, a fixed casing having an internal cylindrical wall surface defining a chamber and having openings for the admission of a fuel-air mixture and for exhausting combustion products, said casing having apertured end plates for passage of a coolant, an elliptical rotor assembly for rotation within said casing chamber about a first axis, said rotor assembly defining combustion chambers closed at their outer ends by the rotor assembly structure, and a fuel-air chamber, said rotor assembly also defining intake and exhaust ports, said intake ports communicating the fuel-air chamber with said combustion chambers, a piston yoke assembly including oppositely projecting pistons and an interconnecting yoke for reciprocal travel within the fuel-air chamber, said yoke having seals extending thereacross, said piston reciprocal travel causing a major length of each piston to move into the fuel-air chamber, said piston yoke assembly rotatable about a second axis offset from the rotor assembly axis, said yoke having first and second fuel compressing surfaces, said yoke reciprocable in said fuel-air chamber to alternately pressurize a fuel-air mixture therein, a fuel-air mixture compressing yoke surface being remote from the combustion chamber served thereby, ignition components carried by said rotor assembly, said casing and rotor assembly jointly defining an area through which fuel and air enter said fuel-air chamber, fixed means on said casing in engagement with said yoke portion to constrain same to rotation about said second axis to thereby impart reciprocal movement to the piston yoke assembly relative the remaining rotor assembly structure to sequentially compress fuel-air charges within said combustion chambers with ignition of same imparting rotational force to the rotor assembly, and said rotor assembly being of substantially elliptical configuration with rotor assembly ends each having a peripheral surface portion closely adjacent the inner surface of the casing walls so as to partially define separate exhaust chambers into each of which an exhaust port discharges.

7. The engine claimed in claim 6 wherein said rotor assembly defines axially extending coolant openings and includes blades affixed thereon inducing a cooling airflow through said casing and said rotor assembly.

8. The engine claimed in claim 6 additionally including an exhaust barrier on said casing and in riding contact with the rotor assembly periphery to scavenge a passing exhaust chamber.

* * * * *